US010479106B2

(12) United States Patent
Burton et al.

(10) Patent No.: US 10,479,106 B2
(45) Date of Patent: Nov. 19, 2019

(54) DROP DETECTOR

(71) Applicant: Hewlett-Packard Development Company, L.P., Houston, TX (US)

(72) Inventors: Gregory N Burton, Camas, WA (US); Jody L Clayburn, Vancouver, WA (US); Kurt F Olsen, Vancouver, WA (US); Steven B Elgee, Portland, OR (US); Jacob McDonald Smith, Vancouver, WA (US); Kenneth Williams, Vancouver, WA (US); Lorraine T Golob, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/067,294

(22) PCT Filed: Apr. 29, 2016

(86) PCT No.: PCT/US2016/030249

§ 371 (c)(1),
(2) Date: Jun. 29, 2018

(87) PCT Pub. No.: WO2017/189007

PCT Pub. Date: Nov. 2, 2017

(65) Prior Publication Data

US 2019/0009570 A1 Jan. 10, 2019

(51) Int. Cl.

| | |
|---|---|
| ***B41J 2/21*** | (2006.01) |
| ***B41J 2/15*** | (2006.01) |
| ***B41J 2/165*** | (2006.01) |
| ***B41J 2/045*** | (2006.01) |

(52) U.S. Cl.
CPC ..... *B41J 2/2142* (2013.01); *B41J 2/04561* (2013.01); *B41J 2/15* (2013.01); *B41J 2/16579* (2013.01); *B41J 2/16585* (2013.01); *B41J 2/2146* (2013.01); *B41J 2202/20* (2013.01)

(58) Field of Classification Search
CPC ..... B41J 2/04561
See application file for complete search history.

(56) References Cited

U.S. PATENT DOCUMENTS

| | | | |
|---|---|---|---|
| 4,540,990 | A | 9/1985 | Crean |
| 5,627,571 | A | 5/1997 | Anderson et al. |
| 7,673,976 | B2 | 3/2010 | Piatt et al. |
| 8,096,633 | B2 | 1/2012 | Takahashi |

(Continued)

FOREIGN PATENT DOCUMENTS

| | | | |
|---|---|---|---|
| JP | 2007076265 | A | 3/2007 |
| KR | 1020140041836 | A | 4/2014 |

OTHER PUBLICATIONS

Impulse Jet. IJ3000 Impulse Jet Ink Jet System Operations Manual. 5760-111 Revision P ~ Illinois Tool Works Inc ~ 2012 ~ 82 pages.

*Primary Examiner* — Julian D Huffman
(74) *Attorney, Agent, or Firm* — Fabian VanCott

(57) ABSTRACT

A drop detector includes a printed circuit board (PCB) including a number of optical channels each formed by a light emitter and a light detector and a number of holes defined in the PCB over which the optical channels pass over and through which a number of ejected drops from a number of printheads pass through wherein each of the number of holes defined in PCB are sized to contour the shape of the number of the printheads.

15 Claims, 7 Drawing Sheets

(56) References Cited

U.S. PATENT DOCUMENTS

| | | | |
|---|---|---|---|
| 8,827,414 | B2 | 9/2014 | Abe |
| 8,857,947 | B2 | 10/2014 | Belbeck |
| 2006/0139392 | A1 | 6/2006 | Fernandez et al. |
| 2007/0024658 | A1 | 2/2007 | Diol et al. |
| 2013/0182031 | A1 | 7/2013 | Govyadinov et al. |
| 2014/0078213 | A1 | 3/2014 | Govyadinov et al. |

DROP DETECTOR

BACKGROUND

Inkjet printing devices use a printing fluid such as an ink to print text, graphics, and images onto a print media. Inkjet printers may use print bars which eject the printing fluid onto a print medium such as paper. Each print bar has a number of printheads that each includes a number of nozzles. Each nozzle has an orifice through which the drops of the printing fluid are fired. The ink ejection mechanism within the printhead may take on a variety of different forms such as thermal printhead technology or piezoelectric technology.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
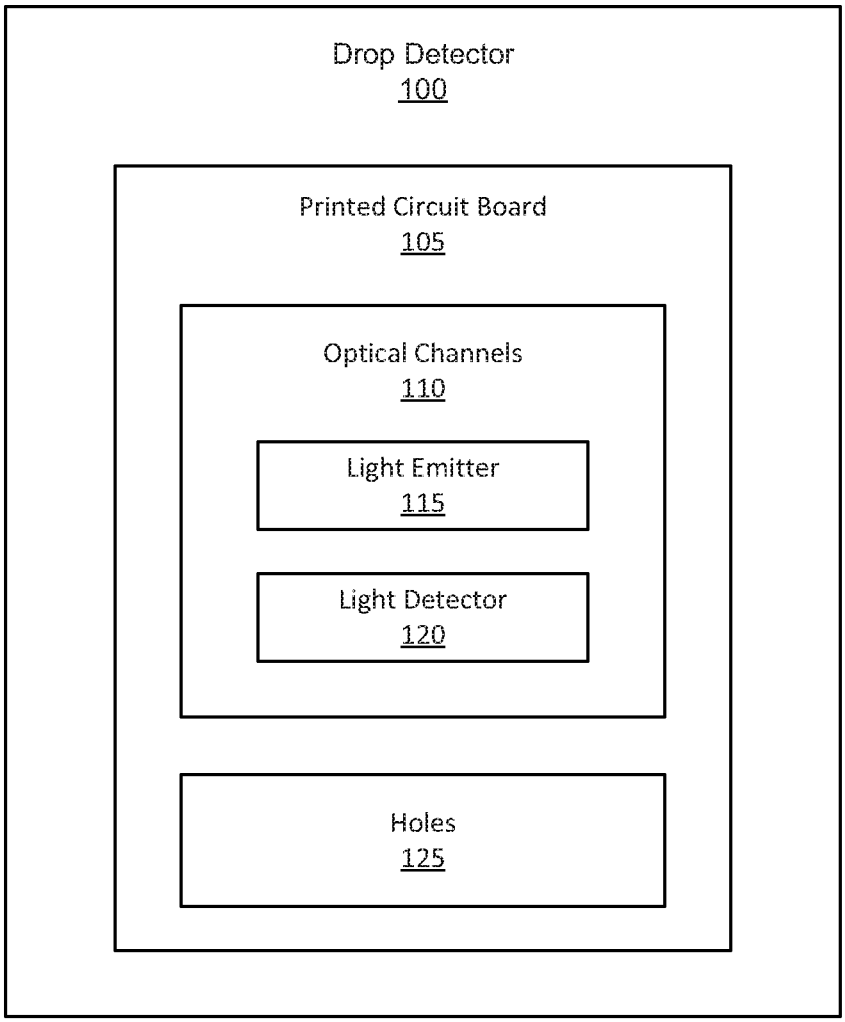
FIG. 1 is a block diagram of a drop detector according to an example of the principles described herein.

As described above, inkjet printing devices comprise print bars comprising a number of printheads. Each printhead comprises a number of nozzles out of which is ejected an amount of printing fluid. The printing fluid may comprise an amount of evaporable constituent such as a solvent which, over time, may evaporate and cause caking of a non-evaporable substance on a surface of or within the nozzles of the printhead. When caking occurs, the nozzles may be blocked causing those nozzles to not fire or misfire. When nozzles misfire or do not fire, print quality is reduced which may be represented in defects in the printed image on the print media.

In order to monitor if nozzles are not firing or misfiring, an optical drop detector may be used to monitor the ejection of droplets of printing fluid out of each nozzle. The present specification describes a low cost through-beam optical drop detector (TBODD) that allows a number of drops ejected from the printhead to pass through a number of holes defined in a printed circuit board (PCB). Across the holes, a number of optical channels are formed by a number of light emitting devices and light detectors. In an example, the light emitting devices are light emitting diodes (LEDs). The size of the hole may be defined by the size of the printhead. In an example, each of the number of holes defined in a PCB are sized to contour to the shape of a number of a printheads. In an example, the number of holes may be two: a first hole for a first "even" printhead and a second hole for a second "odd" printhead. In an example, the number of holes may be 1 with the single hole contouring both a first "even" printhead and a second "odd" printhead.

The present specification, therefore describes a drop detector that includes a printed circuit board (PCB) including a number of optical channels each formed by a light emitter and a light detector and a number of holes defined in the PCB over which the optical channels pass over and through which a number of ejected drops from a number of printheads pass through wherein each of the number of holes defined in the PCB are sized to contour the shape of the number of the printheads.

The specification further describes a printing device including a controller and a drop detector which includes a printed circuit board (PCB) having a number of holes through which a number of droplets of printing fluid may pass and a plurality of light emitting devices and corresponding light detectors to create optical channels across the number of holes. The drop detector detects the number of droplets of printing fluid as they pass through the optical channel.

The specification also describes a method for detecting defective nozzles in a number of printheads including positioning a drop detector including a printed circuit board (PCB) under a print bar of a printing device, the print bar comprising a number of printheads, firing a number of nozzles from a first printhead among the number of printheads through a hole defined in the PCB, and detecting a number of droplets ejected from the number of nozzles as the droplets pass through a number of optical channels each formed by a light emitter and a light detector.

As used in the present specification and in the appended claims, the term "printing fluid" is meant to be any fluid capable of being ejected from a nozzle of a printhead. In an example, the printing fluid is an ink. In another example, the printing fluid is an agent used to help sinter a sinterable material in association with a 3-dimensional printer.

As used in the present specification and in the appended claims, the term "printing device" is meant to be understood as any device that applies a printing fluid onto print media or onto a print target.

Additionally, as used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

FIG. 1 is a block diagram of a drop detector (100) according to an example of the principles described herein. The drop detector (100) may include a printed circuit board (PCB) (105) and a number of holes (125) defined in the PCB (105). The PCB (105) may have a number of optical channels (110) that span across the holes (125). The optical channels (110) are formed by a number of light emitters (115) and light detectors (120). In an example, each optical channel (110) is formed by a single light emitter (115) and single light detector (120). In an example, two optical channels (110) span across each of the holes (125) formed. In an example, four optical channels (110) span across each of the holes (125) formed. Although any number of optical channels (110), light emitters (115), light detectors (120), and holes (125) may be implemented in any number of examples in the present description, the present specification may describe the PCB (105) as having a single hole (125) with four optical channels (110) and their respective light emitters (115) and light detectors (120). In this example, the hole (125) may contour an outer perimeter of two individual printheads: an "odd" printhead and an "even" printhead. Two optical channels (110) may be formed across a portion of the hole (125) where the "odd" printhead is firing while two other optical channels (110) may be formed across a portion of the hole (125) where the "even" printhead is firing. However, any number of optical channels (110) may be formed across any portion of any hole (125) defined in the PCB (105). Consequently, in order to increase the speed of droplet detection, additional optical channels (110) may be formed across any hole (125) such that multiple nozzles from any single printhead may be fired and detected. As the number of drops that can be simultaneously fired and detected increases, so does the speed at which the drop detector (100) finishes detecting ejected droplets from each of the printheads along a print bar. This, in turn, reduces the amount of down time the printer experiences allowing the printer to be used for printing services. Consequently, this increases user satisfaction and productivity.

As described above, the holes (125) in the PCB (105) provide an orifice through which any ejected printing fluid may pass. In an example, the holes (125) are sized to contour the shape of any number of the printheads on the print bar. In an example, a single hole (125) may be formed in the PCB (105) to contour a single printhead. In this example, the hole may outline the outer dimensions of the printhead such that the size of the hole (125) is minimized. Minimization of the hole (125) allows for the light emitters (115) and light detectors (120) to be closer together. This allows for the components to make up the light emitters (115) and light detectors (120) to have relatively less stringent performance requirements. As the distance between the light emitters (115) and light detectors (120) grows, relatively more expensive devices are used to detect the droplets of printing fluid as they pass through the optical channels (110) formed by the light emitters (115) and light detectors (120). With the distance between the light emitters (115) and light detectors (120) reduced to the width of the printhead, less expensive devices can be used. Additionally, as the distance between the light emitters (115) and light detectors (120) is reduced, less mechanical parts may be required. One type of part that can be eliminated from the PCB (105) and optical channel (110) is a lens. Because the distances between the light emitters (115) and light detectors (120) is reduced, the light emitted from the light emitters (115) may be applied without the need for additional optical conditioning. Accordingly, the costs of physical parts and the size of the PCB (105) are reduced.

In an example, a single hole (125) may be formed in the PCB (105) for each printhead to be monitored by the drop detector (100). In this example, the number of printheads monitored may be 1, 2, 3, 4, 5, 6, 7, 8, etc. In another example, a single hole (125) may be formed in the PCB (105) for monitoring a plurality of printheads. In this example, the single hole may be formed in the PCB (105) to monitor 1, 2, 3, 4, 5, 6, 7, 8, etc. printheads. Although the present specification describes a single hole (125) defined in the PCB (105) for detecting droplets ejected from a plurality of printheads, the present specification contemplates the use of any number of holes (125) for any number of printheads. Thus the description herein is not meant to be limiting but is instead meant to be an illustration of merely an example among a number of examples.

As described above, the light emitters (115) may be made of relatively lower cost devices that are capable of emitting light towards a light detector (120). In an example, the light emitters (115) may be a number of light emitting diodes (LEDs). The LEDs may be selected to emit a predetermined wavelength of light such that when a droplet of printing fluid passes in the optical channel (110) formed by the light emitter (115) and the light detector (120), a shadow of the droplet may be detected by the light detector (120). The amount of light that reaches the detector may be measured and it may be determined if a droplet has passed through the optical channel and, if so, how much fluid was in the droplet. Although the present specification describes the light emitters (115) as being an LED, this is meant to be understood as merely an example, and the present specification contemplates the use of any number of different types of light emitting devices.

The light detector (120) may be any device that can detect the presence or absence of light at an end of the optical channel (110). In an example, the light detector (120) is an active-pixel sensor (APS). In another example, the light detector (120) is a complementary metal-oxide-semiconductor (CMOS) sensor. In another example, the light detector (120) is a silicon photodiode. However, other examples of light detectors (120) are contemplated by the present specification and any type of light detector (120) may be used to accomplish the functionality of the drop detector (100) as described herein.

During operation, the drop detector (100) may be positioned to detect any number of droplets of printing fluid ejected from any number of printheads on the print bar. In an example, the PCB (105) has a single hole (125) defined therein contouring the outer dimensions of two printhead such that the drop detector (100) can detect a number of droplets of printing fluid ejected from two individual printheads simultaneously. In order to allow the printing fluid to pass through the hole (125), the drop detector (100) may be positioned under these printheads through the use of a carriage coupled to a rail. Certain gear systems such as a worm gear along with belts and a linear analog encoder may be used to precisely position the holes (125) defined in the PCB (105) under the printheads from which the droplets of printing fluid may be detected. Other types of encoders may be used such as a digital linear encoder and a rotational encoder (digital and analog) and the present specification contemplates the use of these other types of encoders. Additionally, different types of gear or movement systems may be used such as a belt and pulley, a lead screw, and rack and pinion and the present specification contemplates the use of these other types of gear or movement systems.

In an example, printing fluid may be ejected from a single nozzle in each of the printheads. In this example, two optical channels (110) may be formed: one spanning a first portion of the hole (125) directly under a first printhead and the other spanning a second portion of the hole (125) defined directly under a second printhead in the PCB (105). In the example where the print bar is a page-wide array of printheads, the printheads may be situated in an "even" and "odd" printhead configuration. This "even" and "odd" configuration of the printheads is shown in FIG. 2.

Figure 2:
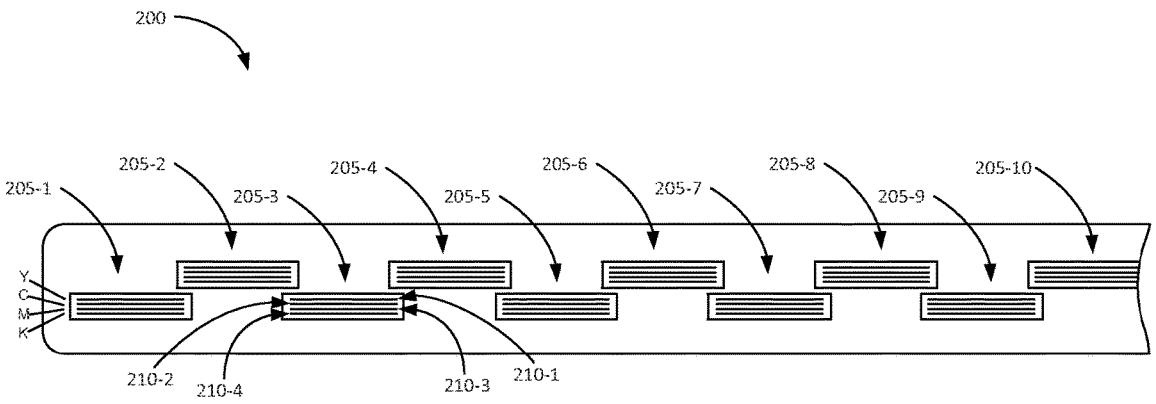
FIG. 2 is a bottom plan diagram of a print bar according to an example of the principles described herein.

FIG. 2 is a bottom plan diagram of a print bar (200) according to an example of the principles described herein. Each printhead (205-1 through 205-10) may overlap another printhead or may have an edge aligned with another printhead (205-1 through 205-10). Although FIG. 2 shows 10 printheads (205-1 through 205-10), the present specification contemplates the use of any number of printheads on a print bar. In an example, the number of printheads is 14. In an example, each printhead is labeled and associated digitally with a number. For example, a first printhead (205-1) may be labeled with a "0", a second printhead (205-2) may be labeled with a "1," a third printhead (205-3) may be labeled with a "2," and so on. Droplets ejected from each nozzle in each even numbered printhead (250-1; 205-3; 205-5, etc.) may be detected using a first set of optical channels (FIG. 1, 110) spanning a first portion of the hole (FIG. 1, 125) defined in the PCB (FIG. 1, 105). Additionally, and simultaneously, droplets ejected from each nozzle in each odd numbered printhead (250-2; 205-4; 205-6, etc.) may be detected using a second set of optical channels (FIG. 1, 110) spanning a second portion of the hole (FIG. 1, 125) defined in the PCB (FIG. 1, 105).

During operation, in an example, the drop detector (FIG. 1, 100) may position the PCB (105) such that the holes (FIG. 1, 125) defined therein are aligned with the printheads as described herein. The alignment of the holes (FIG. 1, 125) assures that, as the printing fluid is ejected from the printheads (205-1 through 205-10), the drops of printing fluid pass through the optical channels (FIG. 1, 110) formed by the light emitters (FIG. 1, 115) and light detectors (FIG. 1, 120).

In an example, two optical channels (FIG. 1, 110) may be formed spanning a single hole (FIG. 1, 125) in order to detect printing fluid droplets ejected from a first printhead. In this example, during operation of the drop detector (FIG. 1, 100), a first light emitter (FIG. 1, 115), and first light detector (FIG. 1, 120) forming a first optical channel (FIG. 1, 110) detects the ejection of printing fluid out of a first nozzle in the printhead. Asynchronously or simultaneously, the ejection of printhead fluid out of a second nozzle may be detected by a second light emitter (FIG. 1, 115) and light detector (FIG. 1, 120) forming a second optical channel (FIG. 1, 110). This process may also occur in association with any number of printheads associated with the print bar (200) either simultaneously or after the PCB (FIG. 1, 105) has been moved to address the individual printheads (205-1 through 205-10). Indeed, in an example where 4 optical channels (110) are used to detect droplets ejected from two separate printheads, all 4 optical channels (110) may detect an ejected droplet of printing fluid simultaneously; two droplets from each printhead are detected simultaneously via the 4 optical channels (110).

In an example, the first nozzle may be the first nozzle in a row (210-1 through 210-4) of nozzles on the printhead while the second nozzle is halfway between the first nozzle in the row (210-1 through 210-4) of nozzles and a last nozzle in that row (210-1 through 210-4) of nozzles. The nozzles may be assigned an individual number by, for example, a controller of a printing system associated with the print bar (200) and drop detector (FIG. 1, 100). In this example, the first nozzle may be nozzle 1 while the second nozzle may be nozzle 528 out of a total of 1056 nozzles in the row.

During operation of the drop detector (FIG. 1, 100), the firing of nozzle 1 of a single row in the first printhead (205-1) may occur about relatively simultaneously with the firing of nozzle 528. In an example, nozzle 1 and nozzle 528 of the second printhead (205-2) may also be fired simultaneously with the firing of nozzles 1 and 528 of the first printhead (205-1). The firing of any nozzle in any row (210-1 through 210-4) may be done so as to allow the drop detector (FIG. 1, 100) to move along the print bar (200) as the firings of the nozzles occurs. After nozzles 1 and 528, for example, are fired nozzles 2 and 529 may be subsequently fired and the droplets ejected therefrom are detected by the drop detector (FIG. 1, 100). This may continue until all the nozzles of the row (210-1 through 210-4) in every printhead (205-1 through 205-10).

Each of the printheads (205-1 through 205-10) may include a number of rows (210-1 through 210-4) of nozzles with each row (210-1 through 210-4) of nozzles ejecting a different kind or color of printing fluid therefrom. In the example shown in FIG. 2, each printhead (205-1 through 205-10) includes 4 rows (210-1 through 210-4) of nozzles. In this example, a first row (210-1) may eject a yellow colored printing fluid, a second row (210-2) may eject a cyan colored printing fluid, a third row (210-3) may eject a magenta colored printing fluid, and a fourth row (210-4) may eject a black colored printing fluid. The number and arrangement of these colors of printing fluids may vary and the present description is meant merely as an example without limitation to the specification.

In an example, in order for the drop detector (FIG. 1, 100) to determine whether each and every nozzle is firing properly, each nozzle may be fired using a predetermined sequence. This is done so that a controller associated with the print bar (200) may fire a particular assigned nozzle and, via the drop detector (FIG. 1, 100), determine whether the nozzle has ejected printing fluid therefrom and, if so, how much. In an example, the firing sequence may include firing nozzles 1 and 528 of each printhead (e.g., 205-1 and 205-2) through the drop detector (FIG. 1, 100) and the associated optical channels (FIG. 1, 110) that are positioned to monitor said printheads. Following this, nozzles 2 and 529 of each of the monitored printheads (e.g., 250-1 and 205-2) may then be fired. This process may continue with each of the successive nozzles until all of the nozzles of the monitored printheads (e.g., 250-1 and 205-2) have been fired. This may continue until each of the first rows (210-1) of the printheads (205-1 through 205-10) have been monitored by the drop detector (FIG. 1, 100). Additional passes along the print bar may continue where additional rows (210-2 through 210-4) of nozzles are defined in the printheads (205-1 through 205-10). In the example shown in FIG. 2, the process described above may continue with the row (210-2) ejecting the cyan colored printing fluid being detected by the drop detector (FIG. 1, 100) in a similar manner as described above.

In an example, the firing of each of the nozzles among the different rows (210-1 through 210-4) of nozzles may be done by implementing an interleaved sequence. In this example, nozzles 1 and 528 of the first row (210-1) of any monitored printhead (e.g., 250-1 and 205-2) may be fired simultaneously with the first optical channel (FIG. 1, 110) detecting the ejected printing fluid from nozzle 1 and the second optical channel (FIG. 1, 110) detecting the ejected fluid from the second optical channel (FIG. 1, 110). Nozzles 1 and 528 of the second row (210-2) of any monitored printhead (205-1 through 205-10) may then be fired. In this example, this may continue until nozzles 1 and 528 of each of the rows (210-1 through 210-4) of any monitored printhead (e.g., 250-1 and 205-2) are fired. The process may continue with nozzles 2 and 529 of each of the rows (e.g., 250-1 and 205-2) being fired consecutively. This process continues until each nozzle in each row (210-1 through 210-4) of every monitored printhead (e.g., 250-1 and 205-2) is fired and the printing fluid ejected therefrom has been detected by the drop detector (FIG. 1, 100). This process is completed for every single printhead (205-1 through 205-10) or sets of printheads (205-1 through 205-10) along the print bar (200) until all nozzles in every row (210-1 through 210-4) of every printhead (205-1 through 205-10) have been fired and monitored by the drop detector (FIG. 1, 100). This example firing sequence may be referred herein as an interleaving sequence.

Figure 3A:
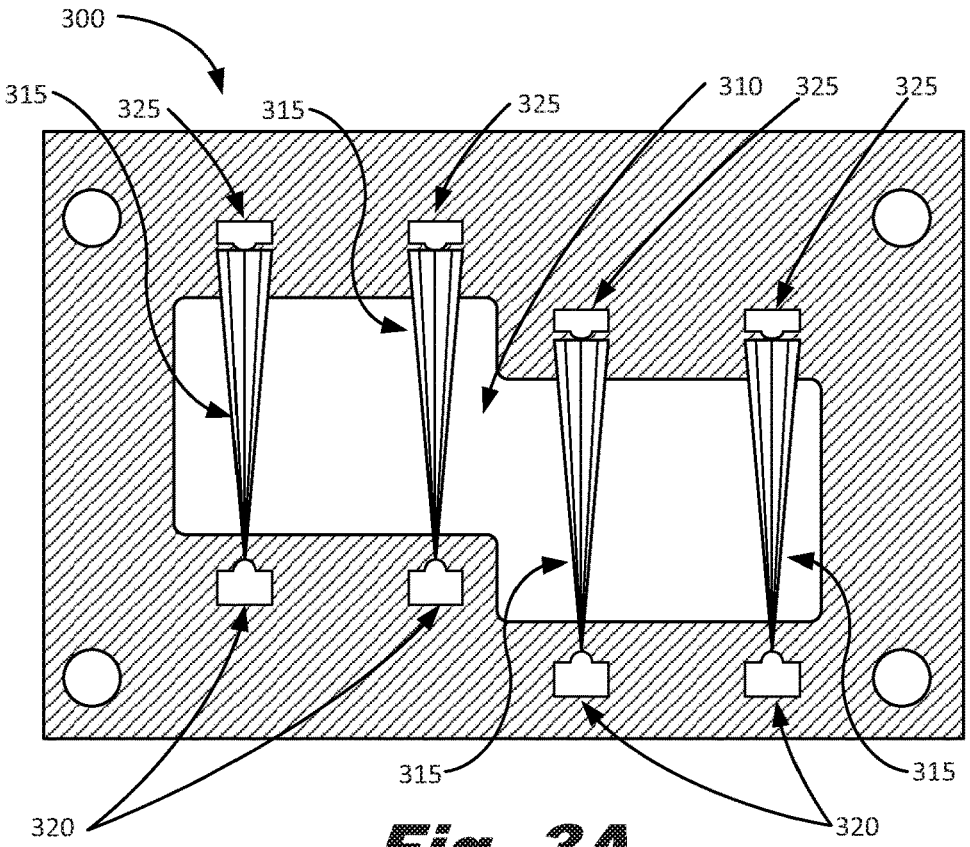
FIG. 3A is a top plan view of a PCB according to an example of the principles described herein.
Figure 3B:
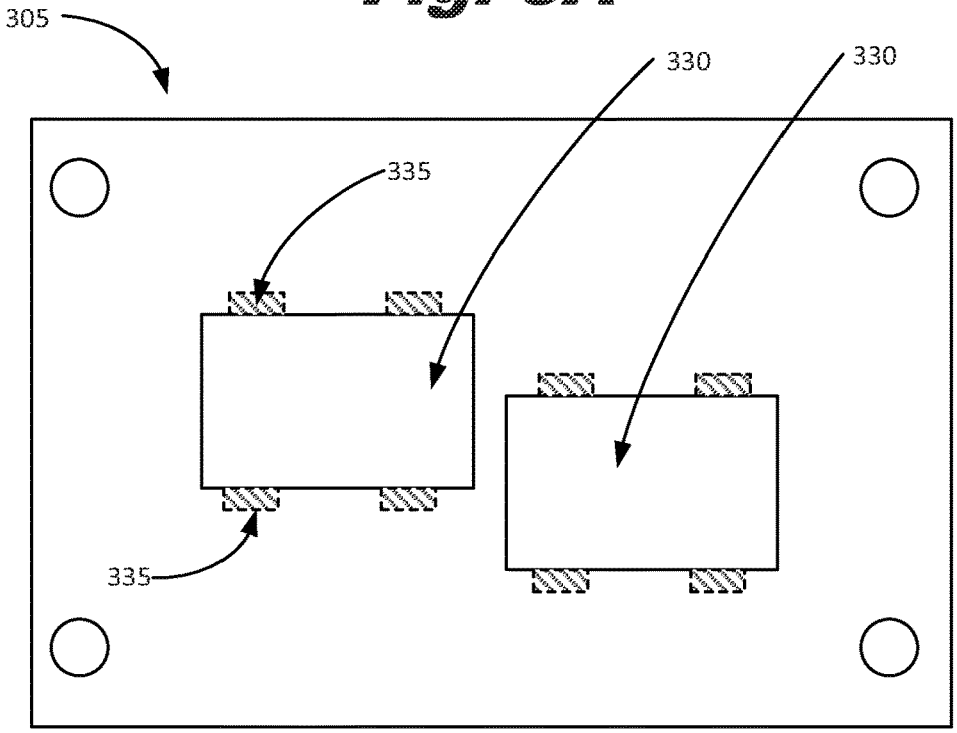
FIG. 3B is a top plan view of a PCB cover according to an example of the principles described herein.

FIG. 3A is a top plan view of a PCB (300) according to an example of the principles described herein. FIG. 3B is a top plan view of a PCB cover (305) according to an example of the principles described herein. As described above, the PCB (300) may have a number of PCB holes (310) defined therein. In the example shown in FIG. 3A, the number of holes is 1. However, any number of holes may be defined in the PCB (300) and each PCB hole (310) may contour the shape of any number of printheads (205-1 through 205-10) on the print bar (200). In the example shown in FIG. 3A, the single PCB hole (310) defines the contour of the two individual printheads (among 250-1 through 205-10): an "even" printhead and an "odd" printhead. However, this is meant merely as an example and two PCB holes (310), for example, may be defined in the PCB (300) in order to accommodate 2 printheads (among 250-1 through 205-10) individually.

In the example show in FIG. 3A, the PCB hole (310) may comprise four individual optical channels (315) created by four light emitters (320) and four corresponding light detectors (325). Two of the optical channels (315) may be used as described above to detect the ejection of printing fluid out of the nozzles associated with a first printhead (205-1 through 205-10) being monitored and the other two of the four optical channels (315) may be used to detect the ejection of printing fluid out of the nozzles associated with a second printhead (among 205-1 through 205-10). This configuration allows for the drop detector (FIG. 1, 100) to detect the ejection of printing fluid from 4 individual nozzles on two different printheads within a single timeframe. As the drop detector (FIG. 1, 100) moves along the print bar (FIG. 2, 200), each nozzle can be fired sequentially as described above in order to determine whether or not printing fluid is being ejected from each of the nozzles in the printhead.

Each of the four light emitters (320) and four corresponding light detectors (325) may be electrically connected to, for example, a controller in a printing device housing the print bar. As will be described in more detail below, a ribbon electrical connector may be provided to connect the PCB (300) to the controller via the carriage. This controller may direct both the firing of the individual nozzles in the individual printheads as well as the movement of a carriage on which the drop detector (FIG. 1, 100) with the PCB (300) is coupled. This movement of the carriage may accurately place the optical channels (315) in the path of each ejected droplet of printing fluid at the correct time the ejection occurs. As described above, the movement of the PCB (300) into the appropriate location may depend on the firing sequence of the nozzles.

The PCB cover (305) shown in FIG. 3B may also include a number of PCB cover holes (330) that match the number of PCB holes (FIG. 3A, 310) of the PCB (FIG. 3A, 300). In the example shown in FIG. 3B, the number of PCB cover holes (330) is two with each hole (330) contouring the shape of two printheads on the print bar. The number of PCB cover holes (330) defined in the PCB cover (305) is in contrast to the number of PCB holes (310) defined in the PCB (300). Although FIGS. 3A and 3B show differing number of PCB holes (310) defined in the PCB (300) as compared to the number of PCB cover holes (330) defined in the PCB cover (305), any number of holes (310, 330) may be defined in these surfaces. Indeed, the present specification contemplates that the number of holes (310, 330) mismatch or match their respective counterparts.

The PCB cover (305) may also include a number of apertures (335) that are situated in front of the light emitters (FIG. 3A, 320) and light detectors when the PCB cover (305) is coupled to the PCB (FIG. 3A, 300). The dimension of the apertures (335) may determine how collimated the admitted rays from each of the four light emitters (FIG. 3A, 320) are as they reach the light detectors (FIG. 3A, 325). In an example, the apertures (335) are rectangular windows, having a small vertical opening of approximately 0.5 to 1.0 mm, and a somewhat larger horizontal opening of approximately 2.0-2.5 mm. The apertures (335) may control the detection Field of View (FOV), prevent optical channel-to-channel cross-talk, and prevent stray light from reflecting off the overlying print bar.

In an example, a number of lenses may also be coupled to the PCB (300) or PCB cover (305) such that they are in dose proximity to the light emitters (FIG. 3A, 320) and light detectors (FIG. 3A, 325) when the PCB cover (305) is coupled to the PCB (FIG. 3A, 300). In this example, the lenses may further help to collimate the light. In another example, no lenses are used and instead, the light from the light emitters (FIG. 3A, 320) is directed to the apertures and to the light detectors (FIG. 3, 325).

Figure 4:
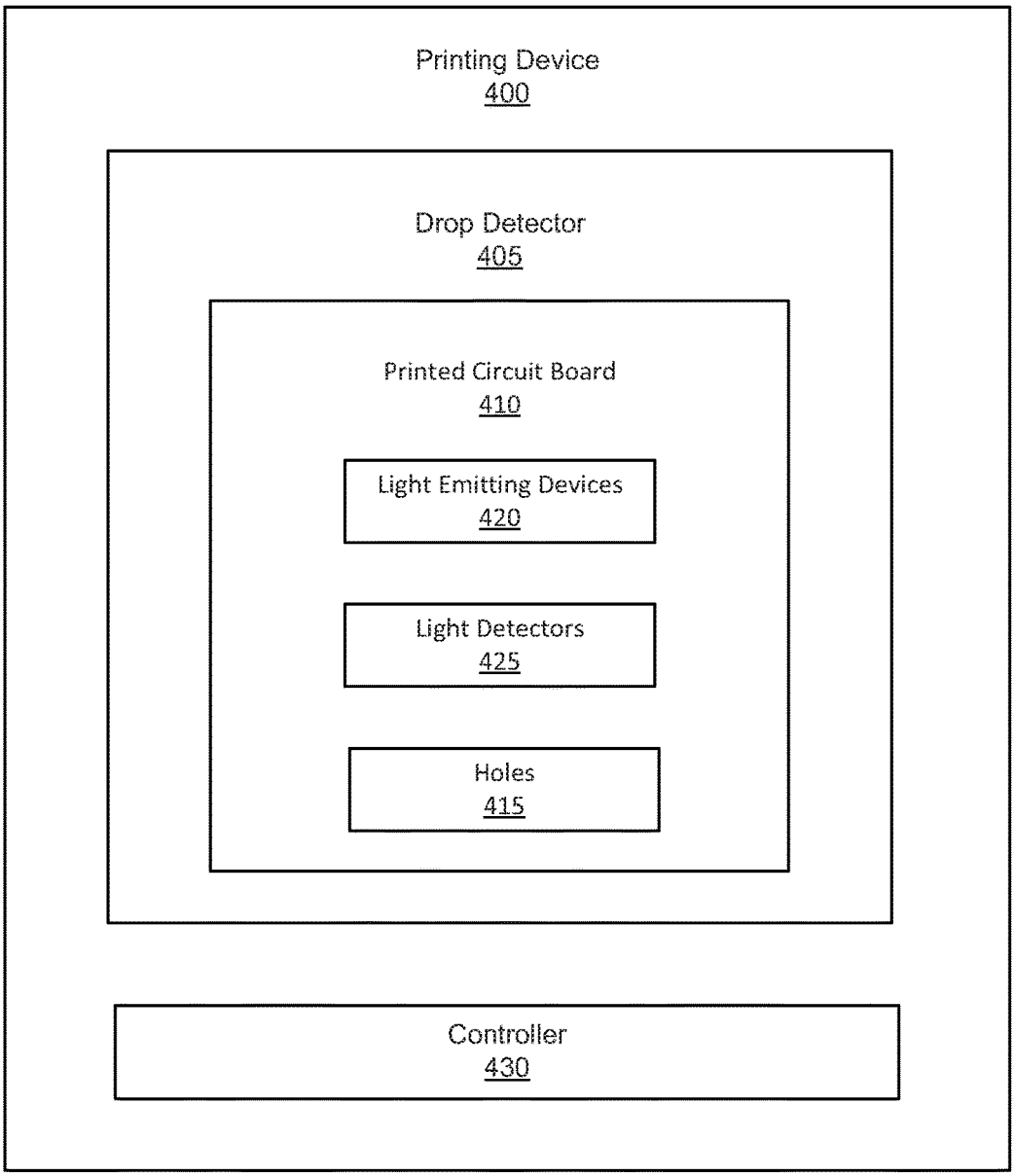
FIG. 4 is a block diagram of a printing device including a drop detector according to an example of the principles described herein.

FIG. 4 is a block diagram of a printing device (400) including a drop detector (405) according to an example of the principles described herein. The printing device (400) includes a drop detector (405) similar to that described above. In an example, the drop detector (405) includes a Printed circuit board (410) having a number of holes (415) defined therein and a number of light emitting devices (420) and light detectors (425) as described above. The printing device (400) further includes a controller (430).

The controller (430) may be communicatively coupled to the drop detector (405). As described above, the controller (430) may receive droplet detection information from the drop detector (405) during operation. In an example, the controller (430) may further cause current (I) applied to the light emitting devices (420) to be adjusted based on, for example, the amount of aerosol printing fluid build-up on the light emitting devices (420) or light detecting devices (425).

The controller (430) may also receive amplified output signals from the individual light detectors (425). These amplified signals may be received by the controller (430) and processed in order to determine which, if any, of the nozzles in the rows of nozzles on the printheads is firing incorrectly. The processing of the signals by the controller (430), rather than with dedicated logic on the PCB (410), allows the physical space occupied by the PCB (410) to be reduced. Additionally, low-profile light emitting devices (420) and light detectors (425) may be used. This, in turn, allows for the light emitting devices (420) and light detectors (425) to be placed much closer to the print bar during operation. Placing the light emitting devices (420) and light detectors (425) closer to the print bar allows for better printing fluid droplet detection because the center of the optical path is placed closer to the ejection site of the individual droplets.

Figure 5:
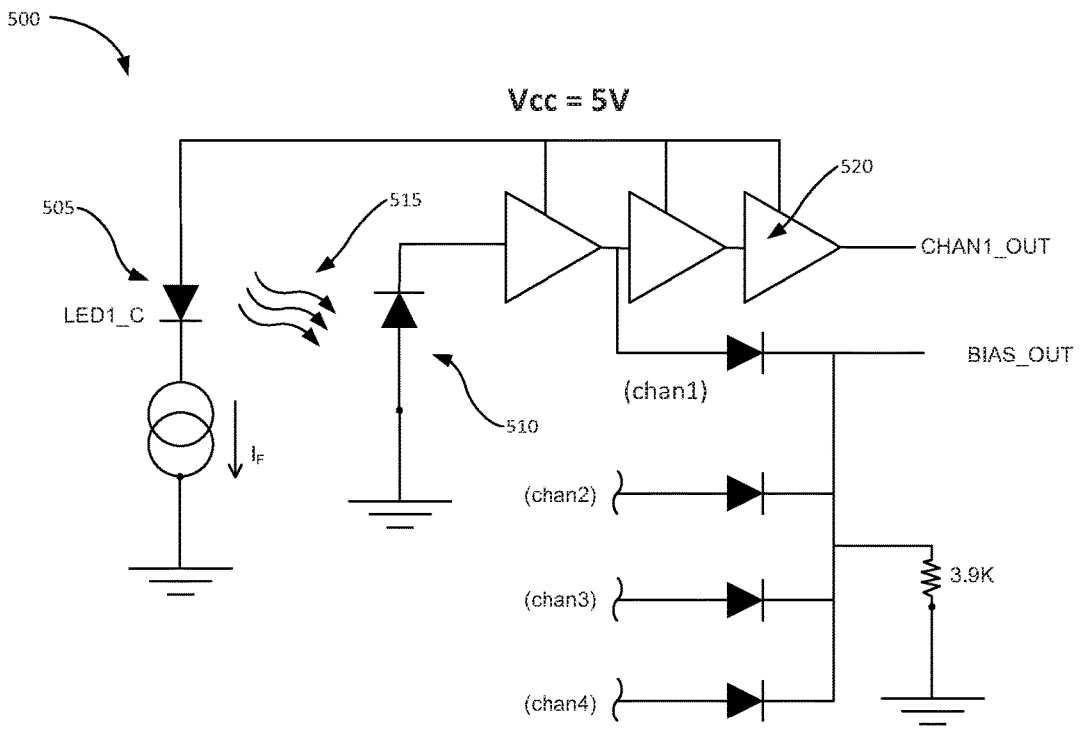
FIG. 5 is a circuit schematic of a PCB according to an example of the principles described herein.

An example circuit used on the PCB (410) is shown in FIG. 5. FIG. 5 is a circuit schematic (500) of a PCB according to an example of the principles described herein.

As described above, the circuit schematic (500) may include a number of light emitters (505); one for every optical channel formed by each light emitter (505) and light detector (510) pair. The controller (FIG. 4, 430) may direct current to be applied to each of the light emitters (505) to cause light (515) to be emitted from the light emitters (505). The light (515) may be received by a light detector (510) and the signal may be sent to a number of amplifiers (520) to be amplified and sent to the controller (FIG. 4, 430) for post-processing. This circuit for the first channel can be repeated for any number of optical channels formed on the PCB (FIG. 4, 410). In the example shown in FIG. 5, there are 4 optical channels, but more or less channels may be formed on the PCB.

As described above, because the PCB (FIG. 4, 410) does not include on-board signal processing circuits, the PCB (FIG. 4, 410) may place the light emitters (505) and light detectors (510) closer to the print bar. In an example, the PCB (FIG. 4, 410) does not include an automatic gain control to control how bright the light emitters (505) are turned on, a microcontroller, or multiplexing channels. The lack of these devices results in the PCB (FIG. 4, 410) being an analog device with signal processing being accomplished by the controller (FIG. 4, 430) of the printing device (FIG. 4, 400). As also described above, this allows the PCB (FIG. 4, 410) to be closer to the print bar, smaller in size, and less expensive.

Figure 6:
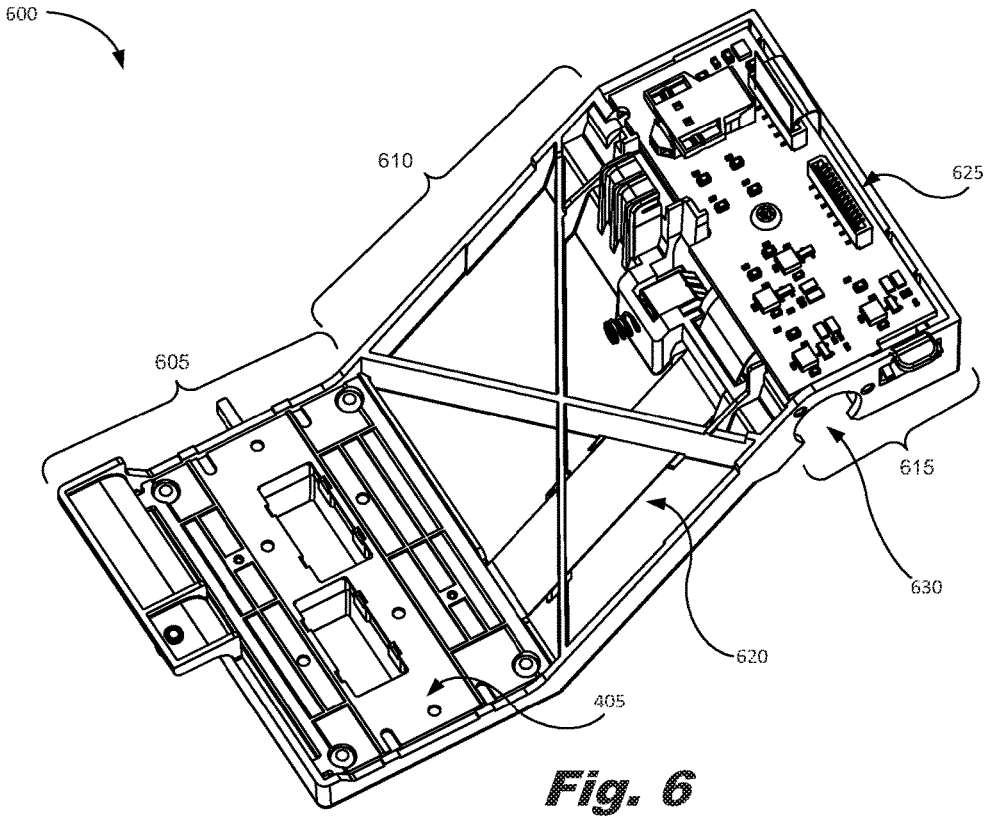
FIG. 6 is a perspective view of a carriage used to transport the drop detector according to an example of the principles described herein.

FIG. 6 is a perspective view of a carriage (600) used to transport the drop detector (FIG. 4, 405) according to an example of the principles described herein. The carriage (600) may comprise a base portion (605), an arm portion (610) and a shoulder portion (615). The base portion (605) may hold the drop detector (FIG. 4, 405) in position under a print bar as described herein. The drop detector (FIG. 4, 405) may be coupled to the base portion (605). Because the drop detector (FIG. 4, 405) communicates with the controller (FIG. 4, 430) of the printing device (FIG. 4, 400), a ribbon cable (620) may run from the drop detector (FIG. 4, 405) through the arm portion (610) and to the shoulder portion (615). The ribbon cable (620) provides the electrical path for any signals from the light detectors flowing to the controller (FIG. 4, 430). The ribbon cable (620) may also be used as a power and signal line where the ribbon cable carries current to the light emitters (FIG. 1, 115), provides the supply voltage for the amplifiers, provides a ground retum path, and provides a "bias_out" signal used, for example, for calibration of the light emitters (FIG. 1, 115) power. The ribbon cable (620) may terminate at a connector (625) which allows further electrical connections to couple the drop detector (FIG. 4, 405) to the controller (FIG. 4, 430) as described herein.

The shoulder portion (615) may be coupled to a rail of the printing device (FIG. 4, 400) via a rail guide (630). As described above, the rail may provide support to the carriage (600) and may allow the carriage (600) to travel along it in order to place the drop detector (FIG. 1, 100) under the print bar at a predetermined location. In order to accurately position the drop detector (FIG. 1, 100) under any given printhead of the print bar, the shoulder portion (615) may further include any number of gears, belts, and analog encoders to accurately position the drop detector (FIG. 1, 100).

In an example, the distance between the PCB (410)/PCB cover (FIG. 3, 305) and the print bar is between 1 and 2 mm. The short distance (1-2 mm) between the PCB (410)/PCB cover (FIG. 3, 305) and the print bar may help reduce the light detector (425) recovery time allowing for faster detection as well as optimized drop detect signal quality.

Figure 7:
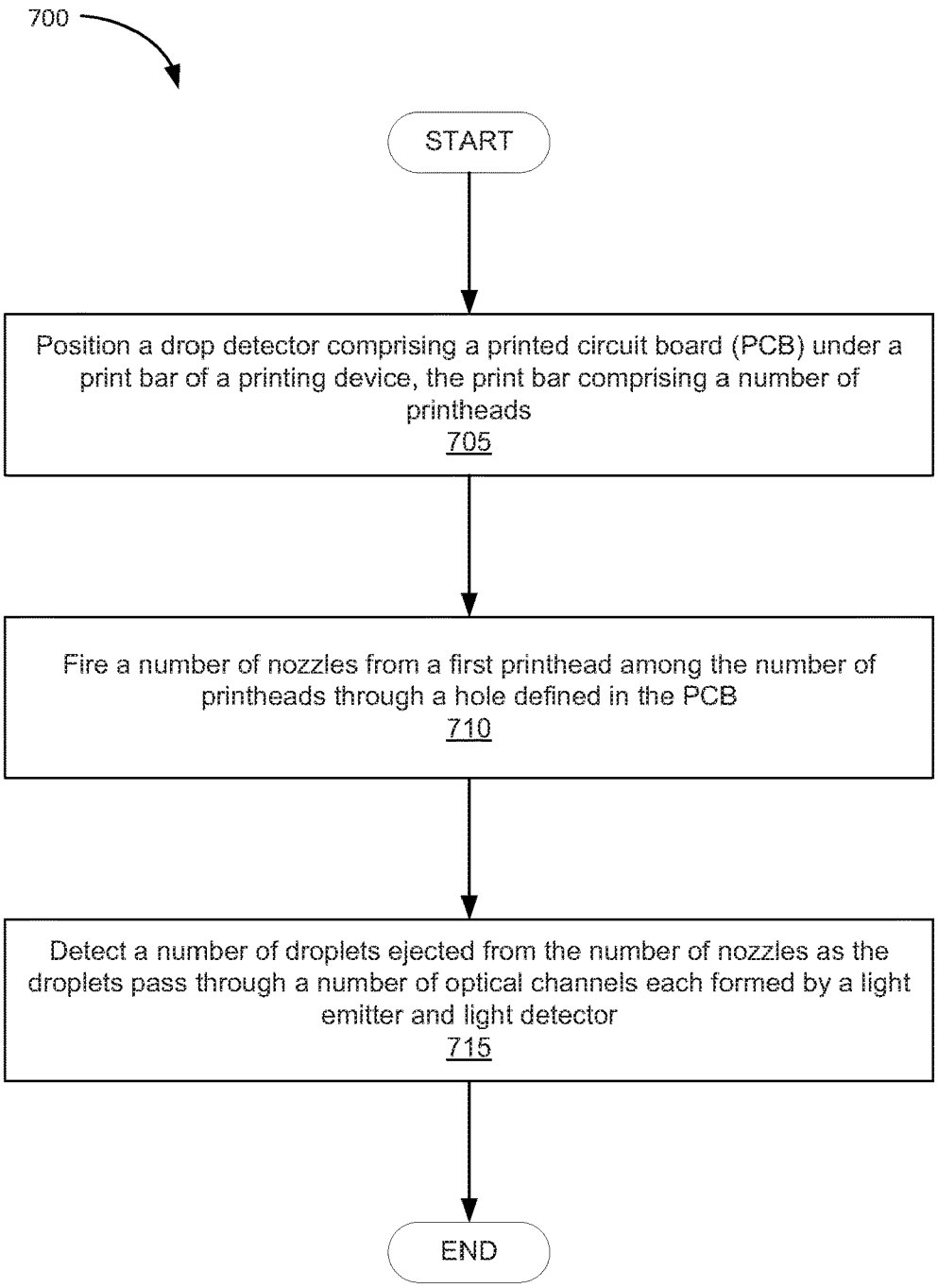
FIG. 7 is a flowchart showing a method of detecting defective nozzles in a number of printheads according to an example of the principles described herein.

FIG. 7 is a flowchart showing a method (700) of detecting defective nozzles in a number of printheads according to an example of the principles described herein. The method (700) may begin by positioning (705) a drop detector (FIG. 4, 405) including printed circuit board (PCB) (FIG. 4, 410) under a print bar of a printing device, the print bar comprising a number of printheads. As described above, the drop detector (FIG. 4, 405) with its PCB (FIG. 4, 410) may be positioned under the print bar and its printheads through the use of a carriage. The carriage may incorporate the use of a number of gears and belts driven by an analog encoder. A controller associated with the carriage and drop detector (FIG. 4, 405) may send instructions to the analog encoder to cause the carriage to move to a predetermined location along the print bar, stop at a predetermined location along the print bar, and move along the print bar at a determined speed and acceleration. This may be done such that the holes defined in the PCB (FIG. 4, 410) align with the individual printheads on the print bar and can align the number of light emitters and light detectors under each nozzle as each of those nozzles are fired.

The method (700) may continue by firing (710) a number of nozzles from a first printhead among the number of printheads through a hole defined in the PCB (FIG. 4, 410). As described above, the PCB (FIG. 4, 410) may have any number of holes defined therein. In an example, a number of holes defined in the PCB (FIG. 4, 410) matches the number of holes defined in a PCB cover that is to cover the PCB (FIG. 4, 410) during operation. In an example, the number of holes defined in the PCB (FIG. 4, 410) do not match the number of holed defined in the PCB cover.

The method (700) may continue by detecting (715) a number of droplets ejected from the number of nozzles as the droplets pass through a number of optical channels each formed by a light emitter and a light detector. As described above, the number of optical channels formed by a light emitter and detector may be any number. In an example, each of the holes formed in the PCB may address a single printhead on the print bar and a single optical channel is formed across each hole. In an example, each of the holes formed in the PCB may address a single printhead on the print bar and two optical channels are formed across the hole. Other examples exist where any number of optical channels are formed across any number of holes defined in the PCB and the present specification contemplates these other examples.

In an example, the firing sequence of all of the nozzles associated with all of the printheads in the print bar may be an interleaved sequence as described above. In an example, the firing sequence of all of the nozzles associated with all of the printheads in the print bar may include firing all rows of nozzles in each of the printheads that eject a first type or color of printing fluid. The sequence may then continue with firing all rows of nozzles in each of the printheads that eject a second type or color of printing fluid, then all rows of nozzles in each of the printheads that eject a third type or color of printing fluid, all rows of nozzles in each of the printheads that eject a fourth type or color of printing fluid, and so on until all rows of nozzles have been fired. In this example, the carriage described above may travel the entire length of the print bar for each type or color of printing fluid ejectable from the printheads. Other firing sequences exist and the present specification contemplates the use of these different types of firing sequences. Because the print bar and printing device cannot be used during the droplet detection process, the firing sequence that lasts the shortest length of time may be used.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the controller (FIG. 4, 430) of the printing device (FIG. 4, 400) or other programmable data processing apparatus, implement the functions or acts specified in the flowchart and/or block diagram block or blocks. In an example, the computer usable program code may be embodied within a computer readable storage medium; the computer readable storage medium being part of the computer program product. In an example, the computer readable storage medium is a non-transitory computer readable medium.

The specification and figures describe a drop detector, a printing device comprising a drop detector, and a method for detecting defective nozzles in a number of printheads. The droplet detector is relatively small and low cost due, at least partially, to the closeness of the light emitters and light detectors. Because the light emitter and light detectors are close to one another, cheaper and smaller parts may be used. This also allows for the optical channels formed by the light emitter and light detectors to be relatively closer to the print bar allowing for more accurate detection of the droplets of printing fluid as the printing fluid is ejected from the nozzles.

Certain optical channels may be devoted to specific printhead positions. This may provide relatively higher signal-to-noise ratio as well as increased tolerance to component alignment of the holes with the printheads. Additionally, the number of optical channels formed across the holes may be scalable such that any number of optical channels may detect the ejection of printing fluid from any number of nozzles in a single printhead. Because of the low cost of the parts used in the optical channels, the costs for additional optical channels to be formed may not increase significantly while the droplet detection time is reduced significantly.

The preceding description has been presented to illustrate and describe examples of the principles described. This description is not intended to be exhaustive or to limit these principles to any precise form disclosed. Many modifications and variations are possible in light of the above teaching.

What is claimed is:

1. A drop detector, comprising:

a printed circuit board (PCB) comprising:

a number of optical channels each formed by a light emitter and a light detector;

a number of holes defined in the PCB over which the optical channels pass over and through which a number of ejected drops from a number of printheads pass through;

wherein each of the number of holes defined in PCB are sized to contour the shape of the number of the printheads.

2. The drop detector of claim 1, wherein the number of optical channels is two for each of the number of holes defined in the PCB.

3. The drop detector of claim 2, wherein, during operation of the drop detector, a first optical channel of the two optical channels detects a drop of fluid ejected from a first nozzle while a second optical channel of the two optical channels detects a drop of fluid ejected from a nozzle located halfway between the first nozzle and a last nozzle in the printhead.

4. The drop detector of claim 1, wherein the drop detector further comprises a top cover comprising a number of top cover holes defined in the top cover and matching the number of holes defined in the PCB.

5. The drop detector of claim 4, wherein, during operation of the drop detector, the distance from the number of printheads to each of the optical channels is between 1 mm and 2 mm.

6. The drop detector of claim 1, wherein the distance from light emitter and light detector forming an optical channel is between 12 to 15 mm.

7. A printing device comprising:

a controller; and a drop detector, comprising:

a printed circuit board (PCB) having a number of holes through which a number of droplets of printing fluid may pass; and a plurality of light emitting devices and corresponding light detectors to create optical channels across the number of holes;

wherein the drop detector detects the number of droplets of printing fluid as they pass through the optical channel.

8. The printer of claim 7, further comprising a print bar comprising a number of printheads; each printhead comprising a number of rows of nozzles wherein the nozzles are fired using an interleaving firing sequence.

9. The printer of claim 7, further comprising a print bar comprising a number of printheads; each printhead comprising a number of rows of nozzles wherein the a first and a middle nozzle are fired simultaneously for each of a first row of nozzles on a number of printheads.

10. The printer of claim 8, further comprising a carriage rail and a carriage wherein the PCB is coupled to the carriage and wherein the controller coordinates the positioning of the carriage and PCB with the firing of any nozzle.

11. The printer of claim 10, wherein the carriage places the PCB 2 to 1 mm from the surface of the print bar.

12. The printer of claim 7, wherein the distance between the light emitting devices and corresponding light detectors is 12 to 15 mm.

13. A method of detecting defective nozzles in a number of printheads, comprising:

positioning a drop detector comprising a printed circuit board (PCB) under a print bar of a printing device, the print bar comprising a number of printheads;

firing a number of nozzles from a first printhead among the number of printheads through a number of holes defined in the PCB; and detecting a number of droplets ejected from the number of nozzles as the droplets pass through a number of optical channels each formed by a light emitter and a light detector.

14. The method of claim 13, further comprising ejecting the droplets of ink in an interleaving sequence.

15. The method of claim 13, further comprising receiving at a controller associated with a printing device signals generated by the light detector and processing those signals at the controller.

* * * * *